US005765573A

United States Patent [19]

Gueret

[11] Patent Number: 5,765,573

[45] Date of Patent: Jun. 16, 1998

[54] APPLICATOR OF MASCARA

[75] Inventor: Jean-Louis H. Gueret, Paris, France

[73] Assignee: L'Oreal, Paris, France

[21] Appl. No.: 705,968

[22] Filed: Aug. 30, 1996

[30] Foreign Application Priority Data

Aug. 30, 1995 [FR] France ..... 95 10232

[51] Int. Cl.[6] ..... A45D 40/26

[52] U.S. Cl. ..... 132/218; 132/216; 132/313; 132/317; 206/581; 206/823

[58] Field of Search ..... 132/218, 216, 132/317, 313, 320, 286; 15/207.2, DIG. 5, 160, 172, 143.1, 144.1; 401/129; 206/581, 823

[56] References Cited

U.S. PATENT DOCUMENTS

| | | | |
|---|---|---|---|
| 4,403,624 | 9/1983 | Montgomery | 132/317 |
| 4,627,125 | 12/1986 | Gruns | 15/207.2 |
| 4,998,315 | 3/1991 | Pessis | 15/160 |
| 5,083,336 | 1/1992 | Atsumi et al. | 15/160 |
| 5,205,301 | 4/1993 | Nakamura | 132/218 |
| 5,238,011 | 8/1993 | Gueret . | |
| 5,345,644 | 9/1994 | Gueret | 132/320 |
| 5,450,865 | 9/1995 | Park | 132/218 |
| 5,504,962 | 4/1996 | Byun | 132/317 |
| 5,507,063 | 4/1996 | Hirsch | 15/207.2 |

FOREIGN PATENT DOCUMENTS

| | | | |
|---|---|---|---|
| 0 556 081 A1 | 8/1993 | European Pat. Off. . | |
| 2 620 603 A1 | 3/1989 | France . | |
| 2 663 826 A1 | 1/1992 | France . | |
| 556081 | 8/1993 | France | 132/317 |
| 2739694 | 3/1979 | Germany | 132/317 |
| 3031131 A1 | 4/1982 | Germany . | |
| 2 564 712 A1 | 11/1985 | Germany . | |
| 3505969 A1 | 8/1986 | Germany . | |
| 2 225 225 | 5/1990 | United Kingdom . | |

*Primary Examiner*—Gene Mancene
*Assistant Examiner*—Pedro Philogene
*Attorney, Agent, or Firm*—Oblon, Spivak, McClelland, Maier & Neustadt, P.C.

[57] ABSTRACT

A mascara applicator and portable packaging unit has a flat handle and at least one tuft of bristles implanted parallel to the plane of the handle. The width of the free end of the tuft of bristles measured along a first direction parallel to this plane is at least equal to a quarter of an arc of the eyelashes. The bristles are capable of loading mascara onto eyelashes along a longitudinal axis of the latter.

38 Claims, 2 Drawing Sheets

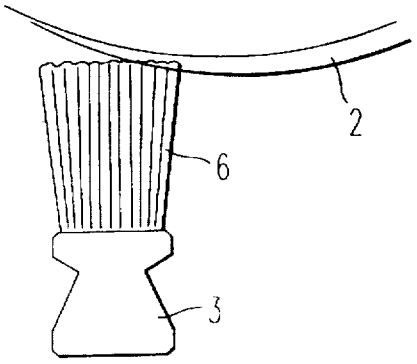
FIG. 1a
PRIOR ART
FIG. 1b
PRIOR ART
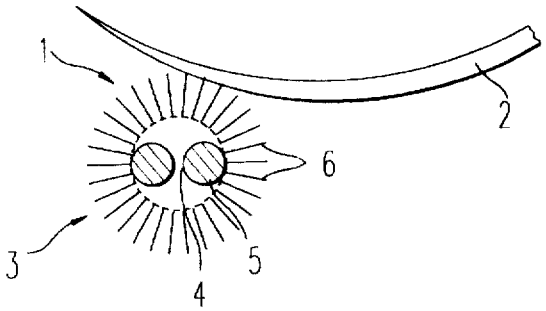
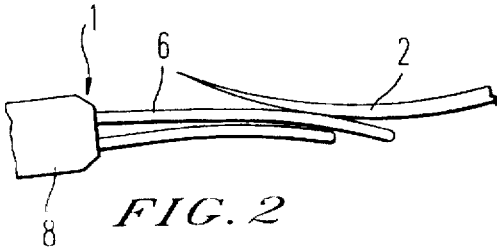
FIG. 2
FIG. 3
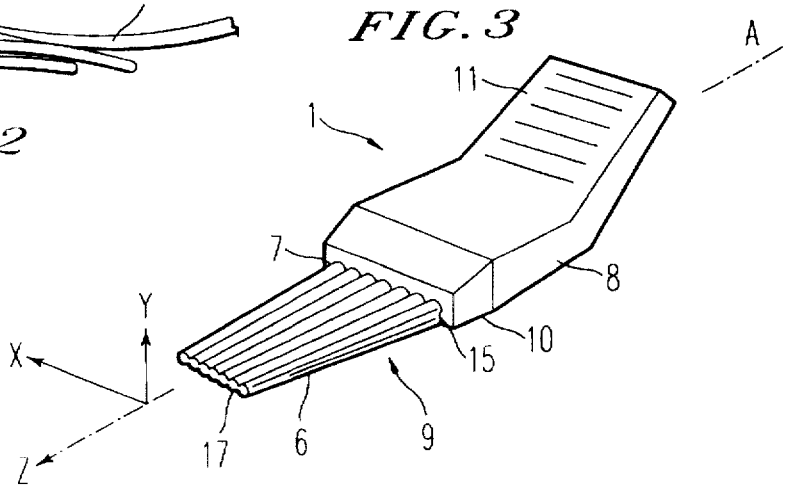
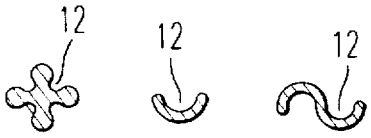
FIG. 4a
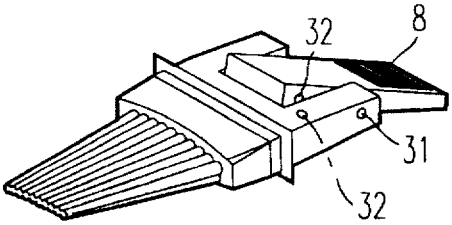
FIG. 11

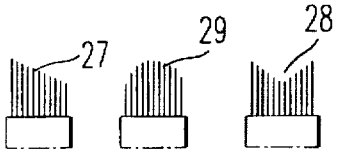
FIG. 4b
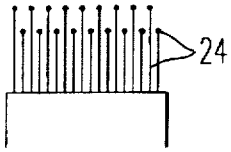
FIG. 4c
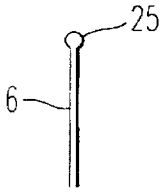
FIG. 4d
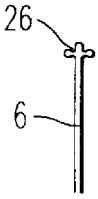
FIG. 4e
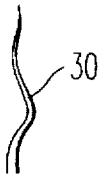
FIG. 4f
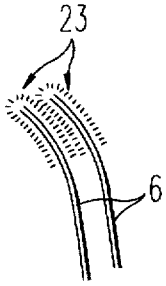
FIG. 4g
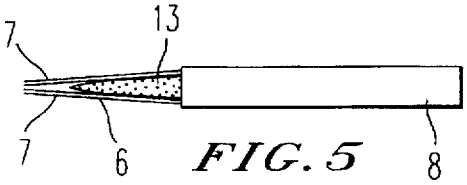
FIG. 5
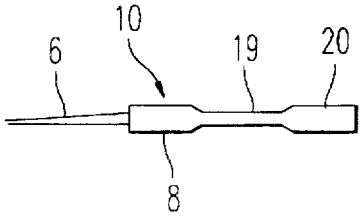
FIG. 6
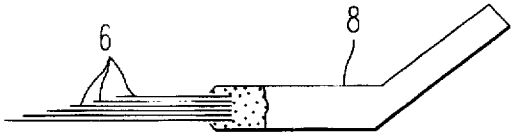
FIG. 7
FIG. 8
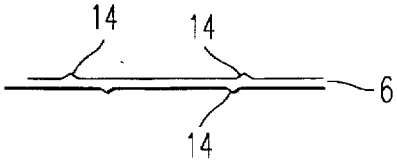
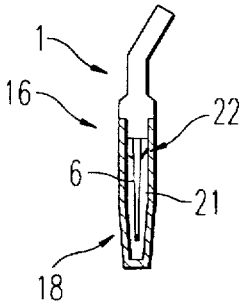
FIG. 10
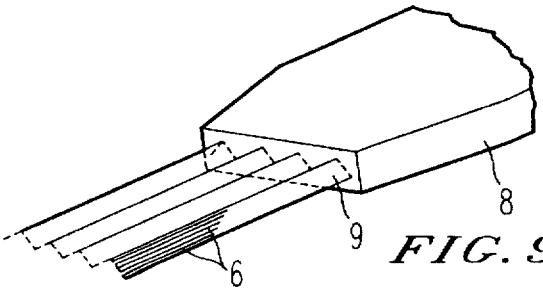
FIG. 9

APPLICATOR OF MASCARA

BACKGROUND OF THE INVENTION

1. Field of the Invention

The invention relates to a liquid to pasty product, particularly mascara, applicator for keratinous fibers such a eye lashes eyebrows hair or bristles, as well as a portable packaging unit for the applicator.

2. Description of the Related Art

Many devices for the application and packaging of mascara have been proposed. For example, as shown in FIG. 1*a*, "cake" mascaras are applied with a brush 3 in the form of a waxing brush, the ends of whose bristles 6 are brushed over a moistened cake of mascara. The surface for the application of the mascara is the surface formed by the ends of the bristles 6 of the brush. In FIG. 1*a*, the brush 3 which loads an eyelash 2 has its bristles 6 perpendicular to the longitudinal axis of the eyelash 2. The amount of mascara applied is proportional to the viscosity of the paste constituted by the moistened cake. However, the use of such a device is tedious. It requires the prior preparation and dosing of the paste, and the make-up application is very imprecise.

Devices have also been proposed which comprise a rigid tubular body having an open end and containing the mascara, and an applicator having a brush which is dipped into the mascara. The brush may be wiped on an element of the body when the applicator is withdrawn from the body.

The attached FIG. 1*b* shows an applicator generally designated 1 conforming to these conventional applicator types. The applicator 1 is provided with a brush 3 having a central core 4 formed by twisted wires 5 tightly holding bristles 6. These bristles 6 form a helix whose axis is the core 4. The making up of keratinous fibers, in particular eyelashes 2, is effected by turning the applicator 1 about the core 4. The smoothing of the eyelashes 2 is therefore performed with the bristles 6 orientated perpendicularly to the eyelashes.

These applicators have many drawbacks. They do not always allow the keratinous fibers (eyelashes) to be loaded in an optimum manner. The bristles of the brush, disposed in a helix perpendicular to the central core of the latter, are short and it is very difficult to smooth the eyelashes over their whole length. The action which causes the applicator to turn about its longitudinal axis is also awkward and very imprecise. The eyelashes are not always properly separated.

Moreover, since the wiping of the brush is effected perpendicularly to the longitudinal axis of the bristles, the formula of mascara is very frequently broken and loses its desired qualities due to changes in viscosity; it may form clots, resulting in a poor smoothing of the eyelashes. This is in particular the case with mascaras with a heavy pigmentary charge. This makes it necessary to use compositions that are not liable to shear, and limits the number of mascara compositions that are usable.

Finally, the body element used for wiping the brush produces a disagreeable sucking noise when the latter is withdrawn, which is due to the low pressure created inside the body.

There thus remains the need for a liquid product, particularly mascara, applicator which ensures a better loading of the keratinous fibers such as eyelashes, as well as an optimum separation of the lashes, while being extremely simple to use.

SUMMARY OF THE INVENTION

It is an object of the present invention to provide an applicator for liquid to pasty products onto keratinous fibers, which ensures a better loading of the fibers as well as an optimum separation of the fibers, while being extremely simple to use.

Thus the invention comprises a liquid to pasty product, particularly mascara, applicator having a flat handle and at least one tuft of bristles implanted parallel to the plane of the handle, the width of the free end of the tuft of bristles measured along a first direction parallel to this plane being at least equal to a quarter of an arc formed by the eyelashes, and these bristles being capable of loading the liquid product onto keratinous fibers along a longitudinal axis of the latter.

The product which is to be applied with the applicator of the invention can be any liquid to pasty product, like pigments and/or fillers comprising fluids, and particularly hair dye or mascara. Keratinous fibers can be eye lashes, eyebrows, hair or bristles.

Such an applicator has many advantages. In particular, its use is easier as compared with the already known mascara applicators. The flat handle can be easily held between the thumb and forefinger. The handle can be more or less curved to the shape of the fingers, in particular the slope of the thumb. Thus the application of the product is no longer effected in an imprecise manner by turning the applicator about its axis but by smoothing the keratinous fibers over their whole length from their bases towards their tips with the bristles touching the eyelashes tangentially. This action is much simpler than with the known applicators. It is, moreover, possible to incline the applicator as desired and thus to bend the eyelashes along the desired curvature.

The bristles have an adequate length to allow the eyelashes to be loaded along the axes of the bristles. They may have different shapes and lengths, and may have capillary grooves or asperities, these diverse configurations ensuring a better application of the product to the eyelashes and simultaneously a better separation of the lashes.

Advantageously, the bristles are combined in tufts of one or more bristles disposed in parallel lines or in a quincuncial arrangement to give a baleen-like shape. The bristles may be rigid or semi-rigid, this rigidity ensuring a more effective smoothing of the eyelashes and very good curving of the latter. The bristles may be made of an elastically deformable material, of metal, of glass, or of wood. The handle of the applicator may be made of a plastic material. One may also make an applicator containing only organic materials.

The particular length of the bristles, as well as their various shapes, ensure an application to the eyelashes that is suited to the user's wishes. Thus fine bristles, thick bristles, short bristles, longer bristles, flocked bristles, bristles having asperities and bristles having different stiffnesses may be mixed according to the desired application. Thick and flocked bristles will apply more mascara to the eyelashes. Bristles having capillary grooves or asperities will separate the eyelashes in a better way. More rigid bristles, as well as a particular inclination of the handle, will ensure an ideal curvature of the eyelashes. Finally, the bristles may also comprise lubricating agents such as molybdenum disulfide, bactericidal agents such as the "Microban" product sold by the Microban Product Company, or moisture-absorbing agents which soften the bristles and alter their surface tension.

The invention also concerns a packaging unit comprising the applicator defined above and a liquid to pasty product reservoir fitted with a wiper. Advantageously, the wiper includes a window whose larger dimension is orientated along the first direction defined above.

The above unit ensures that the bristles are wiped parallel to their longitudinal axis and avoids the unpleasant sucking noise when the applicator is being withdrawn. Moreover, the particles of the product are not broken and the shear phenomenon does not occur. This allows the use of mascara formulae which are generally susceptible to damage by shear and opens the door to new mascara formulations. The configuration of the bristles, advantageously in tufts parallel to the plane of the handle, and not in a helix as with the known mascaras, also avoids spattering of the product.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1*a* is a sectional view of the making up of an eyelash by means of a waxing brush using a "cake" mascara;

FIG. 1*b* is a sectional view of the making up of an eyelash by means of a helical brush having an applicator of a tubular shape;

FIG. 2 is a sectional view of the making-up of an eyelash with an applicator in accordance with the invention;

FIG. 3 is a view in perspective of the applicator in accordance with the invention;

FIG. 4*a* is a sectional view of bristles having at least one capillary groove;

FIG. 4*b* is a sectional view of tufts of bristles cut in particular shapes;

FIG. 4*c* shows bristles of different lengths having small spherical ends;

FIG. 4*d* shows a bristle whose end is in the shape of the head of a nail;

FIG. 4*e* shows a bristle whose end is fork-shaped;

FIG. 4*f* shows a wave-shaped bristle;

FIG. 4*g* shows flocked bristles;

FIG. 5 is a sectional view of the applicator provided with a flock;

FIG. 6 is a sectional view of the applicator having a flexible handle;

FIG. 7 is a view of the applicator with bristles of different lengths injected into the handle;

FIG. 8 is a sectional view of a bristle having asperities;

FIG. 9 is a view of the applicator with tufts of bristles disposed in a quincuncial arrangement;

FIG. 10 is a sectional view of the packaging unit comprising an applicator in accordance with the invention and a mascara reservoir; and FIG. 11 shows an embodiment having an articulated handle.

DETAILED DESCRIPTION OF THE PREFERRED EMBODIMENTS

In the embodiment illustrated in FIG. 3, the applicator, generally referenced 1, has a handle 8 and tufts 9 of bristles 6. The handle 8 has two flat parts, namely a first part 10 wherein the tufts 9 of the bristles 6 are directly implanted, and a second part 11 inclined with respect to the first part 10. In this figure, the two parts are joined and made a single piece, but they could be articulated. FIG. 2 shows the use of the applicator 1 in which the bristles 6 are used over their whole lengths. One thus obtains an optimum loading of the eyelashes 2.

There are defined a first direction X, contained in the plane of the part 10 of the handle 8 and directed perpendicularly to the longitudinal axis A of this handle, a second direction Y, perpendicular to the plane of the part 10 of the handle 8, and a third direction Z perpendicular to X and Y. The tufts 9 of the bristles 6 are implanted in the part 10 parallel to the plane of the latter and along a direction substantially parallel to Z.

By way of example, the handle has a length, measured along direction Z, ranging from 1 to 4 cm.

The tufts of the bristles are implanted, bonded, grafted or injected into the part 10. They are disposed in rows 7, with the bristles 6 interspaced by at most 3 mm measured at their base 15 and along the direction X, and by at most 2 mm measured at their free ends 17 and along the direction X. In FIG. 3, the tufts of the bristles are disposed in two parallel rows 7 and aligned opposite one another.

The width of the set of the tufts 9 of the bristles 6 measured along the direction X at the free ends of the bristles is at least equal to a quarter of the eyelash arc. That is, at least a quarter of the arc formed by the eyelashes of the eye having the mascara applied thereto. It is, in particular, greater than 0.75 cm, preferably ranging from 0.75 to 3 cm. The thickness of the set of tufts 9 of the bristles 6, also measured at the free end of the bristles and along the direction Y, is at most equal to the thickness of the handle, in particular of the part 10, also measured along the direction Y. In practice, this thickness is chosen to be from 0.5 mm to 5 mm.

The length of the bristles 6 measured along the direction Z is sufficient to allow the eyelashes to be loaded along the axis of the bristles. This length is generally more than 5 mm and can be up to 60 mm. It is preferably 5 to 40 mm, and even more preferably 10 to 30 mm. In a preferred embodiment of the invention, the bristles have a length ranging from 15 to 20 mm.

The bristles of the applicator in accordance with the invention generally have a diameter ranging from 0.04 to 0.7 mm, preferably from 0.05 to 0.6 mm and even more preferably from 0.06 to 0.4 mm. Their hardness may range from 10 Shore A to 60 Shore D. The bristles may have identical or different characteristics, shapes and lengths.

The bristles 6 of the applicator 1 in accordance with the invention may be natural or synthetic. They may be made of vegetable or natural fibers, of metal such as steel, of glass, wood or of elastically deformable materials such as vulcanized elastomers or thermoplastic materials. In particular, they may be made of a thermoplastic material injected in the handle, as shown in FIG. 7. Preferably, the bristles are synthetic.

The bristles may have been subjected to flocking and may have shorter bristles 23 at their ends, as shown in FIG. 4*g*; their asperities and their differences in length may be obtained by perpendicular or tangential milling of the bristles or by hot molding. The bristles may have small spheres 24 obtained by carding, as shown in FIG. 4*c*. These small spheres may be situated at different levels of the bristles. The bristles may have been bombarded by gamma or beta rays so as to change their surface state. They may have been milled to obtain a taper. Their free ends may have the shape of a nail head 25, as shown in FIG. 4*d*, or of a fork 26, as shown in FIG. 4*e*.

The bristles may have one or several capillary grooves with different cross-sections, such as the grooves 12 shown in FIG. 4*a*; the tufts of the bristles may be cut in the shape of a bevel 27 or in a concave shape 28, or convex shape 29 as shown in FIG. 4*b*; they may have asperities 14 like the bristle shown in FIG. 8; they may be curved or have undulations over their whole length like the bristle 30 shown in FIG. 4*f*. The applicator may also be provided with a flock 13, i.e., a capillary or impregnable foam disposed between two rows 7 of the bristles 6, as shown in FIG. 5. Such a flock ensures a better loading of mascara on the bristles. In FIG. 5, as compared to FIG. 3, the handle is made of a single flat piece whose median plane is contained in the plane defining the directions X and Z.

In FIG. 11 the bristles as a whole form a curve and the handle 8 is articulated around a hinge 31. The notches 32 retain the handle either parallel to the bristles or at an angle thereto. The articulation can be a film hinge. These features can be incorporated into the other embodiments.

FIG. 6 shows an embodiment of the applicator in accordance with the invention whose handle 8 is flexible. The handle 8 here has three parts: a part 10 similar to that of FIG. 3, a central part 19 whose thickness is less than that of the part 10, and a third part 20 forming an extension of the parts 10 and 19 and whose thickness is substantially equal to that of the part 10. Due to the part 19, the handle 8 is flexible and the applicator can thus be inclined relative to the eyelashes according to the user's wishes. Such a flexible handle also imparts a greater softness to the making up when the application of the product is effected by means of rigid or semi-rigid bristles.

FIG. 7 shows an applicator whose bristles 6 have different lengths and are injected into the handle 8.

In a preferred embodiment of the invention shown in FIG. 9, the tufts 9 of the bristles 6 are disposed in a quincuncial arrangement.

FIG. 10 shows a packaging unit 16 for mascara, comprising the applicator 1 and a reservoir 18 for mascara 21. The unit 16 is shown closed with the applicator 1 serving as a stopper. The reservoir 18 has a wiper 22. In the closed position, the bristles 6 dip into the mascara 21. When the applicator 1 is withdrawn, the bristles 6 are then wiped by the wiper 22 by a simple smoothing of the bristles without any modification of their orientation. This unit is relatively compact and can be easily carried.

In practice, such an applicator is used in an extremely simple way in association with a mascara reservoir such as described above, or even with a "cake" mascara by brushing the applicator of the mascara on the moistened cake.

In using this applicator 1, the mascara is applied to the eyelashes in an extremely simple way, the action for smoothing the eyelashes being effected from the bottom upwards from the base of the eyelashes towards their tips, the bristles of the applicator being parallel to the eyelashes. The action is much more precise than that of the prior art (cf. FIGS. 1*a* and 1*b*). Indeed the flat handle and the special configuration of this applicator make it possible to hold it easily during use and to obtain a better regulated make-up with regard to the eyelashes, thanks to a more ample and freer action. Such an applicator allows the user to actually follow the bristles along the eyelashes and to load the lashes in a very precise manner.

Finally, the user can terminate her action by inclining the applicator so as to orientate the bristles perpendicularly to the eyelashes. She can thus separate and curve the lashes perfectly using the end tip of the bristles.

Such an applicator is very easy to make. The handle may be made, for example, of a molded plastic, of wood or any other material generally used in the manufacture of applicators.

The applicator in accordance with the invention has the advantage of not having a central metallic core. It may therefore be made entirely of organic materials and be recyclable.

Obviously, numerous modifications and variations of the present invention are possible in light of the above teachings. It is therefore to be understood that the invention may be practiced otherwise than as specifically described herein.

What is claimed is:

1. An applicator for applying a liquid to pasty cosmetic product onto a plurality of keratinous fibers comprising:

a flat handle defining a plane;

and at least one tuft of bristles extending from said handle and parallel to the plane of said handle to a free end thereof, wherein the bristles have an adequate length for loading the fibers with the product when moving the applicator so as to keep the bristles in a direction substantially parallel to the lengths of the fibers.

2. An applicator according to claim 1, wherein said width is greater than 0.75 cm.

3. An applicator according to claim 2, wherein said width ranges from 0.75 to 3 cm.

4. An applicator according to claim 1 wherein a thickness of the free end of the tuft of bristles is at most equal to a thickness of the handle, said bristle and handle thicknesses being measured along a second direction perpendicular to said plane.

5. An applicator according to claim 4, wherein the thickness of the free end of the tuft of bristles ranges from 0.5 to 5 mm.

6. An applicator according to claim 4, wherein the bristles have a length ranging from more than 5 to 60 mm, the length being measured along a third direction perpendicular to the first and second directions.

7. An applicator according to claim 6, wherein the bristle length is from 10 to 30 mm.

8. An applicator according to claim 7, wherein the bristle length is from 15 to 20 mm.

9. An applicator according to claim 6 the bristles have a diameter ranging from 0.04 to 0.7 mm.

10. An applicator according to claim 9, wherein the bristles have a diameter ranging from 0.05 to 0.6 mm.

11. An applicator according to claim 10, wherein the bristles have a diameter ranging from 0.06 to 0.4 mm.

12. An applicator according to claim 9 wherein the bristles have a hardness ranging from 10 Shore A to 60 Shore D.

13. An applicator according to claim 6 wherein the bristles are synthetic bristles.

14. An applicator according to claim 13, wherein the bristles are formed from a material chosen from metals and elastically deformable materials.

15. An applicator according to claim 14, wherein the elastically deformable materials are chosen from vulcanized elastomers and thermoplastic materials.

16. An applicator according to claim 15, wherein the bristles are made of a thermoplastic injected into the handle.

17. An applicator according to claim 6 wherein the bristles have at least one capillary groove.

18. An applicator according to claim 6 wherein the bristles have different lengths.

19. An applicator according to claim 6 wherein the bristles have a flock.

20. An applicator according to claim 6 wherein the bristles have asperities.

21. An applicator according to claim 6 wherein the bristles have lubricating and/or bactericidal agents.

22. An applicator according to claim 6 wherein the bristles have moisture-absorbing agents.

23. An applicator according to claim 6 wherein the bristles have undulations.

24. An applicator according to claim 6 wherein the bristles end in small spheres obtained by carding.

25. An applicator according to one of claims 4 or 6 wherein a maximum interspacing between two bristles, measured at the end of the bristles extending from said handle, is 3 mm.

26. An applicator according to claim 1 comprising more than one tuft of bristles.

27. An applicator according to claim 26 wherein the tufts of bristles are disposed in parallel rows.

28. An applicator according to claim 26 wherein the tufts of bristles are disposed in a quincuncial arrangement.

29. An applicator according to claim 1 wherein the at least one tuft of bristles is cut in one of a bevelled, convex or concave shape.

30. An applicator according to claim 1 formed only from organic materials.

31. An applicator according to claim 1 wherein said handle is flexible.

32. An applicator according to claim 1 wherein said handle includes an articulated hinge.

33. An applicator according to claim 32 wherein said handle includes at least one notch for maintaining an angle of articulation thereof.

34. The applicator of claim 1, wherein the plurality of keratinous fibers form an arc, and wherein a width of the free end of the tuft of bristles measured along a first direction parallel to said plane is at least a quarter of the arc formed of the fibers having the cosmetic product applied thereto.

35. A mascara packaging set comprising:

a reservoir containing a liquid mascara product; and an applicator for applying the liquid mascara product onto keratinous fibers, including a flat handle defining a plane, and at least one tuft of bristles extending from said handle and parallel to the plane of said handle to a free end thereof, wherein said at least one tuft of bristles is removably positioned in said reservoir, and a width of the free end of the tuft of bristles measured along a first direction parallel to said plane is at least a quarter of an arc formed of the fibers having the mascara applied thereto.

36. A mascara packaging kit comprising:

a reservoir containing a liquid mascara product; and an applicator for applying the liquid mascara product onto keratinous fibers, including a flat handle defining a plane, and at least one tuft of bristles extending from said handle and parallel to the plane of said handle to a free end thereof, wherein said at least one tuft of bristles is positionable in said reservoir, and a width of the free end of the tuft of bristles measured along a first direction parallel to said plane is at least a quarter of an arc formed of the fibers having the mascara applied thereto.

37. A method for applying a liquid to pasty cosmetic product onto a plurality of keratinous fibers using an applicator including a flat handle defining a plane, and at least one tuft of bristles extending from said handle and parallel to the plane of said handle to a free end thereof, the method comprising the step of moving the applicator so as to keep the bristles substantially parallel to the length of the fibers, so as to load the cosmetic product onto the fibers.

38. The method of claim 37, including the step of orienting the bristles substantially perpendicular to the lengths of the fibers and using the tips of the bristles to separate the fibers.

* * * * *